United States Patent [19]

Gupta et al.

[11] Patent Number: 4,701,575

[45] Date of Patent: Oct. 20, 1987

[54] JACKETED CABLE WITH POWDER LAYER FOR ENHANCED CORROSION AND ENVIRONMENTAL PROTECTION

[75] Inventors: Chakra V. Gupta; Brian D. Garrett, both of Conover, N.C.

[73] Assignee: Comm/Scope Company, Catawba, N.C.

[21] Appl. No.: 867,069

[22] Filed: May 27, 1986

[51] Int. Cl.[4] ..... H01B 7/18; H01B 7/28

[52] U.S. Cl. ..... 174/107; 156/48; 156/51; 174/23 C; 174/106 R; 174/109

[58] Field of Search ..... 174/23 R, 23 C, 107, 174/109, 106 R; 156/48, 51; 427/118

[56] References Cited

U.S. PATENT DOCUMENTS

| | | | |
|---|---|---|---|
| 463,079 | 11/1891 | Snedekor | 174/118 |
| 3,180,926 | 4/1965 | Trill | 174/107 |
| 3,711,621 | 1/1973 | Jachimowicz | 174/107 X |
| 3,875,323 | 4/1975 | Bopp et al. | 174/23 C |
| 3,963,854 | 6/1976 | Fowler | 174/106 R X |
| 4,004,077 | 1/1977 | Woytiuk | 174/23 C |
| 4,110,137 | 8/1978 | Beach | 156/48 |
| 4,201,250 | 5/1980 | Walling et al. | 174/23 C |
| 4,206,790 | 6/1980 | Walling | 174/23 C |
| 4,419,157 | 12/1983 | Ferrentino | 156/56 |
| 4,435,693 | 3/1984 | Johnson | 174/102 P X |
| 4,472,597 | 9/1984 | Uematsu | 174/106 R |
| 4,599,121 | 7/1986 | Edwards et al. | 156/48 |
| 4,621,169 | 11/1986 | Petinelli et al. | 174/23 C |

*Primary Examiner*—Morris H. Nimmo

*Attorney, Agent, or Firm*—Bell, Seltzer, Park & Gibson

[57] ABSTRACT

A corrosion-resistant electric cable has a metallic conductor, a polymeric insulating jacket surrounding the metallic conductor, and a corrosion-inhibiting powder comprised of a hydrophobic material disposed between the metallic conductor and the insulating jacket. The corrosion-inhibiting powder may be comprised of a mixture of a hydrophobic fumed silica powder and a hydrophobic polyethylene powder.

18 Claims, 3 Drawing Figures

JACKETED CABLE WITH POWDER LAYER FOR ENHANCED CORROSION AND ENVIRONMENTAL PROTECTION

FIELD OF THE INVENTION

The present invention relates to shielded electrical cable generally, and particularly relates to a shielded electrical cable having a corrosion-inhibiting powder which coats its conductor to prevent damage thereto by moisture which may enter the cable through its insulating jacket.

BACKGROUND OF THE INVENTION

Numerous types of jacketed electrical cables are exposed to an environment which can corrode their inner metallic conductors. One such cable is drop wire, which is an electrical cable used to bring a cable TV signal from a common line into an individual home. Typically, drop wire is either buried underground, or run in the open where it is exposed to the environment. In either case moisture can penetrate the cable through nicks and cuts in its protective outer jacket, corrode the metallic conductors, and require replacement of the cable. To a cable company which must maintain thousands of miles of drop wire in the field, an improvement in the moisture resistance of the drop wire will result in a significant saving in cost.

To prevent corrosion within cable, the interiors of cables have been flooded with semisolid hydrophobic materials, such as waxes, greases, etc. Exemplary of this approach are U.S. Pat. Nos. 3,875,323 to Bopp and 4,110,137 to Beach. A disadvantage of this design is that the flooding material can flow out of the cable through cuts in its jacket, resulting in a decrease in corrosion resistance. This is particularly true at the cut ends of the cable (making such cable messy to handle), and where the cable is exposed to wide temperature fluctuations.

SUMMARY OF THE INVENTION

We have found that excellent corrosion resistance can be achieved in an electrical cable when a hydrophobic material is incorporated into the cable in powder form. Such a material can be conveniently coated onto a metallic conductor during the manufacture of a cable before an insulating or protective layer is extruded over the conductor.

A cable of the present invention will accordingly be comprised of at least one metallic conductor, a polymeric insulating jacket surrounding the conductor, and a corrosion-inhibiting powder comprised of a hydrophobic material disposed between the metallic conductor and the insulating jacket. It is contemplated that this invention will be useful with a variety of different types of single and multiconductor cable, as well as with drop wire.

BRIEF DESCRIPTION OF THE DRAWINGS

The foregoing and other objects, features and advantages of the invention will be made apparent from the following description of the preferred embodiments and the drawings, in which.

DETAILED DESCRIPTION OF THE INVENTION

Figure 1:
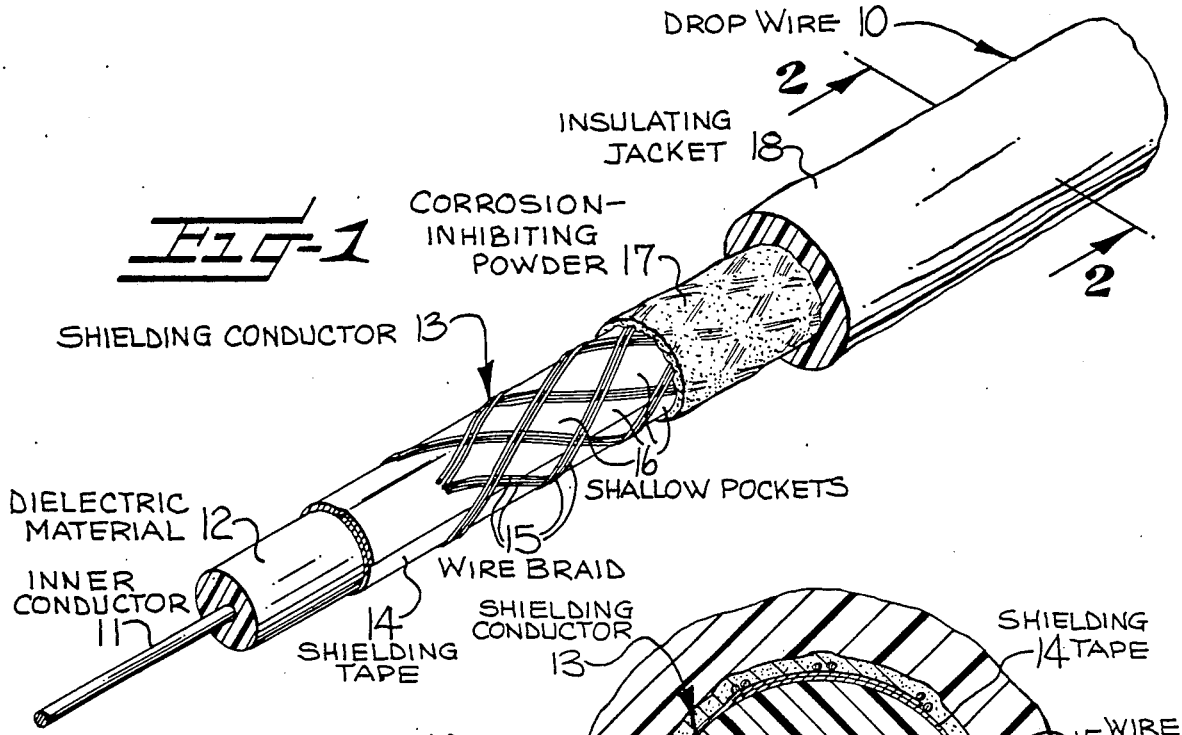
FIG. 1 is a perspective view of a cable embodying the present invention, with the various layers of the cable serially stripped away to reveal the interior construction.
Figure 2:
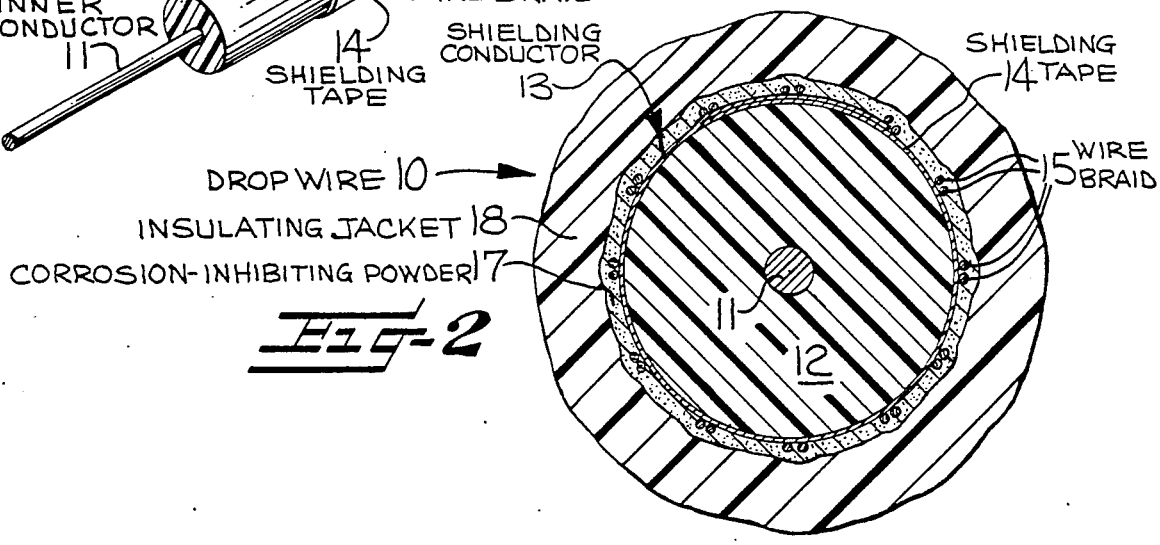
FIG. 2 is a cross-sectional view of a cable of the present invention taken along line 2—2 of FIG. 1.

FIGS. 1 and 2 illustrate a preferred embodiment of the present invention: a drop wire 10 having a corrosion-inhibiting powder serving to protect the shielding conductor from corrosion. It will be seen from these figures that such a cable has a metallic inner conductor 11 with a dielectric material 12 surrounding the inner conductor. The dielectric material is preferably a polyolefin dielectric such as foamed polyethylene.

A metallic shielding conductor 13 surrounds the dielectric material and the inner conductor. In the preferred embodiment, the shielding conductor is formed from two separate elements: a metallic shielding tape 14 which surrounds the dielectric material 12, and an open wire braid 15 surrounding the metallic shielding tape. Preferably, the metallic shielding tape is sealed to the dielectric by a thin adhesive layer.

A polymeric insulating jacket 18 surrounds the shielding conductor to form a protective outer covering for the cable, and a corrosion-inhibiting powder 17 is disposed between the metallic shielding conductor 13 and the insulating jacket 18, thoroughly coating the metallic surfaces of the shielding conductor. The use of an open wire braid 15 surrounds the metallic shielding tape 14 provides a plurality of shallow pockets 16 adjacent the shielding tape between the individual strands (or groups of strands) of the braid, so that the corrosion-inhibiting powder will be dispersed in the pockets and trapped therein by the insulating jacket applied therearound. This aids in preventing shifting of the powder 17, as the powder is not a self-sustaining layer.

The corrosion-inhibiting powder is a finely divided particulate material having hydrophobic properties. The hydrophobic powder serves to prevent any moisture which might enter the cable from traveling longitudinally along the cable beneath the jacket, and to thereby protect the metallic conductor from the corrosive influence of the moisture.

The powder can be formed of a variety of different materials, such as mica or fumed silica. If the material selected is not inherently hydrophobic, it can be surface coated with a hydrophobic agent to render it hydrophobic. Suitable hydrophobic agents for surface coating include, for example, hydrophobic polyfunctional silanes, and hydrophobic titanate coupling agents such as those available from Kenrich Petrochemicals, Inc. It is important, however, that the materials selected provide a flowable powder comprised of smooth-surfaced particles, as such a powder is less likely to clump and aggregate during application of the powder or when an insulating jacket is being extruded around the metallic conductor. The powder should also preferably have a density sufficient to cause it to readily settle onto the metallic conductor when it is being applied thereto.

The hydrophobic corrosion-inhibiting powder is preferably comprised of fumed silica which has been surface coated with a hydrophobic agent. Particularly suitable is a fumed silica powder which has been surface treated with a hydrophobic polyfunctional silane, such as "Cabosil TS-720," manufactured by The Cabot Corporation of Boston, Mass. A second, relatively dense, hydrophobic powder material is preferably mixed with the hydrophobic fumed silica to facilitate the manufacture of the cable. We used a polyethylene powder which was surface coated to render it hydrophobic and sold under the name "Polymist A-12" by the Allied Chemical Co.

Hydrophobic fumed silica powder and hydrophobic polyethylene powder were mixed in various proportions, incorporated into cable, and the cable tested for corrosion resistance with the ASTM-B-114 salt spray test. The results of these tests are set forth in the Table. Smaller values in the spray end and opposite end columns indicate superior corrosion resistance. Quantities of powders used are expressed on a percent by weight basis.

CORROSION RESISTANCE PROVIDED BY DIFFERENT POWDER BLENDS

| Powder Content | | Corrosion Observed | |
|---|---|---|---|
| Hydrophobic Fumed Silica | Hydrophobic Polyethylene | Spray End | Opposite End |
| 0 | 0 | 4.6" | 4.6" |
| 90 | 10 | .0" | .0" |
| 80 | 20 | .4" | .4" |
| 70 | 30 | .263" | .263" |
| 60 | 40 | .25 | .25 |
| 50 | 50 | .25 | .26 |
| 40 | 60 | .29 | .26 |
| 30 | 70 | .25 | .25 |
| 20 | 80 | .35 | .35 |
| 10 | 90 | .5" | .4" |

The preferred proportion was 60% hydrophobic fumed silica to 40% hydrophobic polyethylene.

Figure 3:
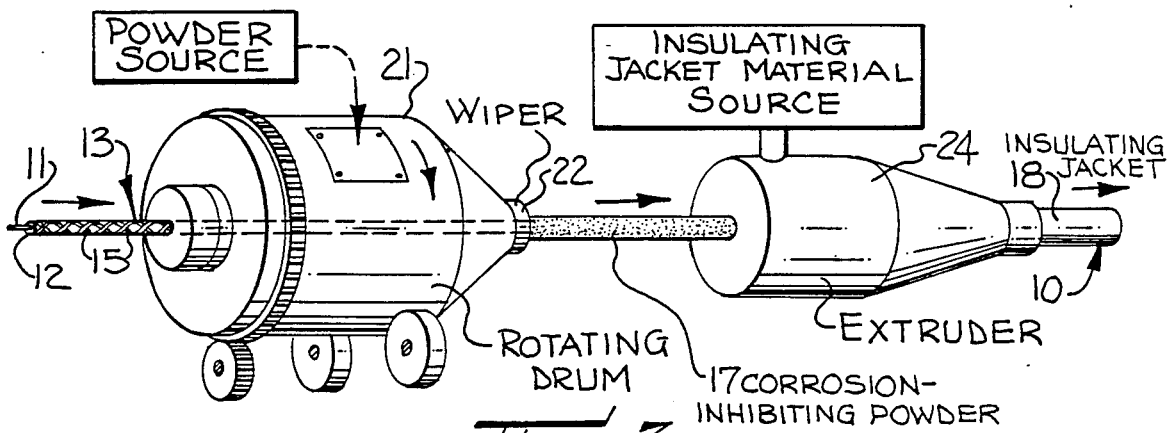
FIG. 3 illustrates a method of making a cable of the present invention.

A cable of the present invention can be conveniently manufactured according to the procedure set forth in FIG. 3. A partially constructed cable comprised of a metallic inner conductor 11, a dielectric material 12 surrounding the inner conductor, a metallic shielding tape 13 surrounding the dielectric material and the inner conductor, and an open wire braid 15 surrounding the metallic shielding tape is advanced along a predetermined path into a coating station comprised of a rotating drum 21, which drum contains a corrosion-inhibiting powder. The rotating drum is adapted to contact the metallic conductor 20 with powder by tumbling the powder therearound, thereby forming a powder coating around the metallic conductor. Excess powder is thereafter removed with a wiper 22. The partially completed cable, now coated with corrosion-inhibiting powder 17, is then advanced into an extruder 24, where a polymeric insulating jacket 18 is applied by extruding it around the metallic conductor to produce a corrosion-resistant electric cable 10. While this method has been explained with particular reference to drop wire, it can also be used to provide a corrosion-inhibiting powder layer between any metallic conductive surface and a surrounding insulating or protective layer.

The foregoing examples are illustrative of the present invention rather than restrictive. Those modifications which come within the meaning and range of equivalents of the claims are to be included therein.

That which is claimed is:

1. A corrosion-resistant cable comprising at least one metallic conductor, a polymeric insulating jacket surrounding said conductor, and a corrosion-inhibiting hydrophobic powder disposed between said metallic conductor and said insulating jacket and coating said at least one metallic conductor, said powder serving to prevent any moisture which might enter the cable from traveling longitudinally along the cable beneath said jacket in corrosive contact with said metallic conductor.

2. A corrosion-resistant cable as claimed in claim 1, wherein said corrosion-inhibiting hydrophobic powder is comprised of flowable, smooth-surfaced hydrophobic particles.

3. A corrosion-resistant cable according to claim 1, wherein said corrosion-inhibiting hydrophobic powder comprises hydrophobic fumed silica.

4. A corrosion-resistant cable as claimed in claim 3, wherein said hydrophobic fumed silica has been surface coated with a hydrophobic agent.

5. A corrosion-resistant cable as claimed in claim 4, wherein said hydrophobic agent is a hydrophobic polyfunctional silane.

6. A corrosion-resistant cable comprising at least one metallic inner conductor, a dielectric material surrounding the inner conductor, a metallic shielding conductor surrounding the dielectric material and the inner conductor, a polymeric insulating jacket surrounding said shielding conductor and forming a protective outer covering for the cable, and a corrosion-inhibiting hydrophobic powder disposed between said metallic shielding conductor and said insulating jacket and coating said metallic shielding conductor, said powder serving to prevent any moisture which might enter the cable from traveling longitudinally along the cable beneath said jacket in corrosive contact with said metallic shielding conductor.

7. A corrosion-resistant cable comprising a metallic inner conductor, a polyolefin dielectric material surrounding the inner conductor, a metallic shielding tape surrounding the dielectric material and the inner conductor, and an open wire braid surrounding the metallic shielding tape so that a plurality of shallow pockets are formed adjacent the metallic shielding tape between the individual strands of the wire braid, the cable further comprising a corrosion-inhibiting hydrophobic powder coating said metallic shielding tape and dispersed in the pockets formed in said wire braid and a polyolefin insulating jacket surrounding said wire braid so that said corrosion-inhibiting powder is trapped in the pockets formed therein, said powder serving to prevent any moisture which might enter the cable from traveling longitudinally along the cable beneath said jacket in corrosive contact with said metallic shielding tape and said wire braid.

8. A corrosion-resistant cable according to claim 6 or 7, wherein said corrosion-inhibiting hydrophobic powder comprises hydrophobic fumed silica.

9. A corrosion-resistant cable according to claim 6 or 7, wherein said corrosion-inhibiting hydrophobic powder comprises a mixture of hydrophobic fumed silica powder and hydrophobic polyethylene powder.

10. A method of making a corrosion-resistant cable having at least one metallic conductor, said method comprising coating the metallic conductor with a corrosion-inhibiting hydrophobic powder and then applying a polymeric insulating jacket around the powder-coated metallic conductor to form a protective covering which traps the hydrophobic powder as a layer against the metallic conductor.

11. A method according to claim 10 wherein the step of coating the metallic conductor with a corrosion-inhibiting hydrophobic powder comprises applying to the conductor hydrophobic fumed silica powder.

12. A method according to claim 10, wherein the step of coating the metallic conductor comprises tumbling a corrosion-inhibiting powder around the cable, which powder is a relatively dense powder that uniformly coats the conductor.

13. A method according to claim 10, wherein the step of coating the metallic conductor comprises applying to the conductor a hydrophobic fumed silica powder and a hydrophobic polyethylene powder.

14. A method of imparting corrosion resistance to a cable having a metallic conductor comprising the steps of advancing a cable having an exposed metallic conductive surface along a predetermined path of travel to and through a coating station; contacting the exposed metallic conductive surface with a corrosion-inhibiting hydrophobic powder and forming a powder coating around the metallic conductor; and advancing the powder coated cable from the coating station to an extruder and extruding a jacket of polymeric insulating material around the powder coated metallic conductor.

15. A method according to claim 14, wherein the step of contacting the metallic conductive surface with a corrosion-inhibiting hydrophobic powder comprises applying to the conductive surface a hydrophobic fumed silica powder.

16. A method according to claim 14, wherein the step of contacting the metallic conductive surface with a corrosion-inhibiting hydrophobic powder comprises tumbling a corrosion-inhibiting powder around the cable, which powder is a relatively dense powder that uniformly coats the conductor.

17. A method according to claim 14, wherein the step of contacting the metallic conductive surface with a corrosion-inhibiting hydrophobic powder comprises applying to the surface a hydrophobic fumed silica powder and a hydrophobic polyethylene powder.

18. A corrosion-resistant cable comprising at least one metallic conductor, a polymeric insulating jacket surrounding said conductor, and a corrosion-inhibiting hydrophobic powder disposed between said metallic conductor and said insulating jacket, said corrosion-inhibiting hydrophobic powder comprising a mixture of hydrophobic fumed silica and hydrophobic polyethylene powder, said corrosion-inhibiting hydrophobic powder serving to prevent any moisture which might enter the cable from traveling longitudinally along the cable beneath said jacket in corrosive contact with said metallic conductor.

* * * * *